US006045637A

United States Patent [19]

Grzyll

[11] Patent Number: 6,045,637

[45] Date of Patent: Apr. 4, 2000

[54] SOLID-SOLID HYBRID GAS GENERATOR COMPOSITIONS FOR FIRE SUPPRESSION

[75] Inventor: Lawrence R. Grzyll, Merritt Island, Fla.

[73] Assignee: Mainstream Engineering Corporation, Rockledge, Fla.

[21] Appl. No.: 09/123,287

[22] Filed: Jul. 28, 1998

[51] Int. Cl.[7] ..... C06B 45/10; A62C 31/02

[52] U.S. Cl. ..... 149/19.3; 252/5

[58] Field of Search ..... 149/19.3, 19.6, 149/19.91; 252/4, 5, 6, 7

[56] References Cited

U.S. PATENT DOCUMENTS

| | | | |
|---|---|---|---|
| 3,741,585 | 6/1973 | Hendrickson et al. | 280/150 |
| 3,779,823 | 12/1973 | Price et al. | 149/19 |
| 3,806,461 | 4/1974 | Hendrickson et al. | 252/188.3 |
| 4,358,327 | 11/1982 | Reed, Jr. et al. | 149/19.4 |
| 4,601,344 | 7/1986 | Reed, Jr. et al. | 169/47 |
| 5,053,147 | 10/1991 | Kaylor | 252/7 |
| 5,080,735 | 1/1992 | Wagner | 149/19.3 |
| 5,423,384 | 6/1995 | Galbraith et al. | 169/12 |
| 5,425,886 | 6/1995 | Smith | 252/5 |
| 5,503,086 | 4/1996 | Henry et al. | 149/19.4 |
| 5,520,826 | 5/1996 | Reed, Jr. et al. | 252/5 |
| 5,588,493 | 12/1996 | Spector et al. | 169/46 |
| 5,613,562 | 3/1997 | Galbraith et al. | 169/12 |
| 5,861,106 | 1/1999 | Olander | 252/7 |

OTHER PUBLICATIONS

Robert M. Mitchell, *Advanced Fire Suppression Technology (AFST) Research and Development,* Sep. 1994.

David D. Thurston, *Inert Gas Generators Used for Fire Protection Aboard Navy Aircraft,* Apr. 27, 1995.

"U.S. Navy F/A–18E/F Inert Gas Generator Program," International Conference on Ozone Protection Technologies, Oct. 21–23, 1996.

Donna Guesto–Barnak et al., "Fire Test Results for Solid Propellant Inert Gas Generators In the Walter Kidde Aerospace Dry Bay Fire Simulator," *Halon Options Technical Working Conference,* 1996, pp. 75–87.

Gary F. Holland et al., "Fire Suppression Using Solid Propellant Gas Generator Technology," *Halon Options Working Conference,* May 6–8, 1997, pp. 485–498.

*Primary Examiner*—Charles T. Jordan
*Assistant Examiner*—Aileen J. Baker
*Attorney, Agent, or Firm*—Evenson, McKeown, Edwards & Lenahan P.L.L.C.

[57] ABSTRACT

A solid-solid hybrid gas generator composition includes a solid gas generator material and a solid, flame retardant material. The flame retardant material may include one or more bromine-, chlorine- and phosphorous-containing compounds. The gas generator material and flame retardant material may be in the same vessel.

17 Claims, No Drawings

SOLID-SOLID HYBRID GAS GENERATOR COMPOSITIONS FOR FIRE SUPPRESSION

BACKGROUND OF THE INVENTION

The present invention relates to a solid-solid hybrid gas generator composition for use in fire suppression methods and applications. The hybrid gas generator system is a mixture of a solid gas generator material with a solid flame retardant material.

Flame retardants are not the same as fire suppressants. Flame retardants (fire retardants) are materials that are usually incorporated into fabrics, plastics, or other solid materials to decrease flammability and to inhibit flame initiation and flame spreading. Fire extinguishants (fire suppressants) are applied to an existing fire to effect suppression. The mechanisms of flame retardants and of fire extinguishants may be entirely different. The present invention relates to a composition containing inert gas generators and flame retardants to function as a hybrid fire suppression composition that is applied to an existing fire.

DESCRIPTION OF THE RELATED ART

The search for fire suppression technologies that can replace ozone-depleting halons has been underway for over ten years. These efforts have typically been aimed at (1) halon replacements, which are chemically-acting and/or physically-acting agents similar to halons; or (2) halon alternatives, which are non-halocarbon suppression technologies. Halon replacement agents include many of the halogenated hydrocarbons that have been evaluated over the years. Examples of halon alternatives include water misting, particulate aerosols, inert gas generators, and hybrid systems that combine one or more technologies.

Inert gas generators typically use thermochemical means to rapidly produce and expel inert gases to suppress fires. Their use involves the activation of a thermochemical reaction in the gas generator that results in formation of an inert gas, for example, $CO_2$, $N_2$, $H_2O$, as well as a solid particulate byproduct. The product gases are emitted at temperatures ranging from 1200° F. to 2000° F. Automotive air bags are perhaps the best known use of chemically activated inert gas generators.

U.S. Pat. No. 3,806,461 discloses a gas generating composition containing cupric oxalate, potassium perchlorate and an organic fuel binder. The composition is useful in safety crash bags. U.S. Pat. No. 3,741,585 discloses a nitrogen gas generating composition containing metallic azides and reactants such as metallic sulfides, metallic iodides, organic iodides, organic chlorides, metallic oxides and sulfur. U.S. Pat. Nos. 3,779,823, 4,358,327, 4,601,344 and 5,053,086 also disclose gas generator compositions.

There has been continued research directed at developing and evaluating inert gas generators for fire suppression in military applications. However, there are several drawbacks to conventional inert gas generator fire suppression systems. First, the inert gas exhaust is extremely hot, ranging from 1200° F. to 2000° F. Second, because inert gas generators suppress fires by physical means, significant quantities of inert gas are required to extinguish the fire. For example, the cup burner flame extinguishing concentrations for nitrogen and carbon dioxide are 31.3% (v/v) and 20.4% (v/v), respectively, compared to Halon 1301 (i.e., $CF_3Br$) which has a flame extinguishing concentration of 3.0% (v/v). A major improvement to this technology could be achieved if fire suppression by chemical extinguishment could be accomplished.

Solid-liquid hybrid gas generation technology has also been explored to cool the hot exhaust gas. In these hybrid systems, the inert gas is discharged into a second pressure vessel containing a liquid fire suppression agent, which is pressurized and heated by the generated gas and discharged via a burst disk. Liquid fire suppression agents that have been tested include water, $CO_2$, fluorocarbon agents such as HFC-227ea, HFC236fa, and $CF_3I$. However, these hybrid systems have several drawbacks. First, solid-liquid hybrid systems require a second pressure vessel to store the liquid agent. This second storage vessel adds weight and size to the system. Second, the liquid fire suppression agents all have their own individual disadvantages. HFC-227ea and HFC-236fa generate potential global warming gases that have long atmospheric lifetimes, and may face future environmental regulations. $CF_3I$ is a known cardiac sensitizer. Water and $CO_2$ have drawbacks for many applications that are well-documented in literature. For example, water is an electrical conductor and its use around electrical devices is hazardous. The sublimation characteristics of carbon dioxide result in a portion of the $CO_2$ forming a dry ice mass that is not of use in fire suppression. Third, the hybrid systems do cool the exhaust gas to below that of the gas generator only system, but the exhaust gas temperature is still hot and a potential hazard.

Other hybrid systems, containing a mixture of inert gas generators and solid fire suppression agents, have been evaluated. U.S. Pat. No. 5,423,382 discloses an apparatus for suppressing a fire comprising a gas generator containing a propellant and a fire suppressant. Known solid fire suppression agents include potassium bicarbonate, ammonium phosphate, potassium chloride, granular graphite, magnesium hydroxide, and other inorganic solid fire suppression agents. These hybrid systems also have several disadvantages. First, they do not cool the exhaust gas. Second, the solid fire suppression agents are not "clean agents" and leave a solid residue, which is unacceptable in areas such as computer and electronic rooms.

SUMMARY OF THE INVENTION

I have developed an innovative solid-solid hybrid gas generator that overcomes the above-described drawbacks of the gas generator technologies. The hybrid system of the present invention involves the general principle of mixing a solid gas generator material with a solid flame retardant material.

DETAILED DESCRIPTION OF INVENTION

The flame retardant material in the hybrid gas generator of the present invention has several functions.

First, its decomposition results in the formation of radical scavenging decomposition products that serve as chemically-acting fire suppression agents and are subsequently delivered to a fire. Since chemically-acting agents are delivered to the fire, significantly less inert gas needs to be delivered. Thus, the hybrid system of the present invention is significantly smaller and lighter than current state-of-the-art gas generator fire suppression systems.

Second, it serves as a heat sink for the exothermic gas generation reaction, resulting in delivery of a cool gas to the fire. When exposed to the heat of gas generation reaction, it can absorb heat by melting (heat of fusion), vaporizing (heat of vaporization), and decomposing (heat of reaction).

Third, when formulated directly with the inert gas generator, it acts as a binder for the formulation. This feature makes the formulation abrasion resistant, which is an attractive feature for long-term storage.

Examples of currently preferred inert gas generator materials include, but are not limited to, those found in U.S. Pat. No. 5,423,384, which is incorporated by reference herein in its entirety. For illustration purposes, several compositions are listed below in Table 1. However, any solid propellant capable of generating inert gases such as $N_2$, $O_2$, $H_2O$, $CO_2$, or others are suitable.

TABLE 1

Inert Gas Generator Compositions

| Components | Compositions, wt. % |
|---|---|
| 5-aminotetrazole | 28.62% |
| strontium nitrate | 57.38% |
| clay | 8.00% |
| potassium 5-aminonitrate | 6.00% |
| 5-aminotetrazole | 29.20% |
| strontium nitrate | 50.80% |
| magnesium carbonate | 20.00% |
| guanidine nitrate | 49.50% |
| strontium nitrate | 48.50% |
| carbon | 2.00% |
| 5-aminotetrazole | 30.90% |
| potassium perchlorate | 44.10% |
| magnesium carbonate | 25.00% |
| potassium chlorate | 61.0% |
| carbon | 9.0% |
| magnesium carbonate | 30.0% |
| sodium azide | 59.1% |
| iron oxide | 39.4% |
| potassium nitrate | 1.0% |
| carbon | 0.5% |

Other examples of preferred inert gas generator compositions can be found in U.S. Pat. Nos. 5,053,086, 4,601,344, 4,358,327, 3,806,461, 3,741,585, and 3,779,823, all of which are incorporated herein by reference in their entirety. In embodiments, the inert gas generator materials are combinations of high nitrogen content compounds with energetic binders. Examples of high nitrogen content compounds include, but are not limited to, ammonium 5-nitroaminotetrazole, triaminoguanidinium 5-nitroaminotetrazole, aminoguanidinium 5,5'-bitetrazole, guanidinium 5,5'-bitetrazole, and the like. Examples of energetic polymers include, but are not limited to, a copolymer of 3,3-bis(azidomethyl) oxetane and tetrahydrofuran, and a copolymer of 3,3-bis(azidomethyl) oxetane, 3-nitromethyl-3-methyloxetane, combinations thereof and the like. In embodiments, the weight ratio of nitrogen compounds to polymer is about 50:50.

Examples of solid, flame retardant materials include, but are not limited to, a wide variety of bromine-containing flame retardants. These bromine-containing materials have melting points above room temperature. Thus, they can absorb significant energy due to their heat of fusion. They also decompose to form bromine radicals above about 500° F. This decomposition results in additional energy absorption as well as the formation of decomposition product radicals that are delivered to the fire and are available to suppress the fire chemically. Table 2 demonstrates the bromine content, melting range, volatility and bulk density for some flame retardants used in some embodiments of the present invention.

TABLE 2

Flame Retardants for Solid-Solid Hybrid Gas Generator System

| Flame Retardant | Bromine Content | Melting Range (° C.) | Volatility (TGA, wt. loss) | Bulk Density (g/ml) |
|---|---|---|---|---|
| Tetrabromobisphenol A and Derivatives | | | | |
| Tetrabromobisphenol A | 58.8% | 179–181 | 95% @ 500° C. | 1.36 packed |
| Tetrabromobisphenol A bis(2-hydroxyethyl ether) | 50.6% | 113–118 | 95% @ 501° C. | 1.20 packed |
| Tetrabromobisphenol A bis(2,3-dibromopropylether) | 67.7% | 106–120 | 50% @ 337° C. | 1.10 packed |
| Tetrabromobisphenol A bis(allyl ether) | 51.2% | 115–120 | 50% @ 332° C. | 1.08 packed |
| Tribromophenol and Derivatives | | | | |
| 2,4,6-Tribromophenol | 72.5% | 95–96 | 95% @ 330° C. | 1.24 packed |
| Tribromophenol allyl ether | 64.2% | 74–76 | 50% @ 208° C. | 1.19 packed |
| Poly-dibromophenylene oxide | 62.0% | 210–240 | 95% @ 590° C. | 0.64 packed |
| bis(Tribromophenoxy) ethane | 70.0% | 223–228 | 95% @ 450° C. | 1.10 packed |
| Brominated Diphenyl Oxides | | | | |
| Decabromodiphenyl oxide | 83.3% | 300–315 | 95% @ 447° C. | 1.42 packed |
| Octabromodiphenyl oxide | 79.8% | 70–150 | 95% @ 396° C. | 1.48 packed |
| Pentabromodiphenyl oxide | 70.8% | liquid | 95% @ 340° C. | 2.3 |
| Dibromostyrene and Derivatives | | | | |
| Dibromostyrene | 59.0% | liquid | 95% @ 272° C. | 1.8 |
| Poly-(dibromostyrene) | 59.0% | 220–240 | 95% @ 460° C. | 1.11 packed |
| Polypropylene-dibromostyrene | 36.0% | 160–175 | 50% @ 431° C. | 0.81 packed |
| Others | | | | |
| Tetrabromophthalic anhydride | 68.2% | 270–276 | 95% @ 325° C. | 2.09 packed |
| Hexabromocyclododecane | 74.7% | 185–197 | 50% @ 283° C. | 1.54 packed |

Bromine radicals are known to be significantly more effective than fluorine radicals at fire suppression. The flame retardants of Table 1 have bromine contents as high as 83.3 wt %. This compares to Halon 1301 which has a bromine content of 53.7%. The solid-liquid hybrid systems described in the Description of the Related Art above contain no bromine.

Other embodiments may use alternative commercially-available flame retardants, including chlorinated, fluorinated, or phosphorus-based compounds. Examples of these flame retardants are shown below in Table 3. However, the gas generator compositions of the invention are not limited to the flame retardants shown in either Table 2 or Table 3. Any flame retardant material, copolymer, composite, blend, or mixture is suitable.

TABLE 3

| | |
|---|---|
| Chlorinated | chlorinated paraffins |
| Fluorinated | polytetrafluoroethylene (PTFE) |
| Phosphorus-Based | phosphoric acid esters |
| | polyphosphoric acid ammonium |
| Others | magnesium hydroxide |
| | aluminum hydroxide |
| | antimony trioxide |
| | zinc borates |

The solid-solid hybrid gas generator of the present invention has many advantages over conventional inert gas generator systems and the hybrid systems that use liquid or vapor agents. Because solid chemically-acting agents in addition to the inert gases are delivered to the fire, the system is smaller and lighter than conventional inert gas generators. Only one storage vessel is needed because the solid halogen-containing flame retardants are in the same vessel as the gas generator materials. They can either be mixed with inert gas generator material after formulation or can be formulated as part of the gas generator. This eliminates the need for a second storage cylinder, which is required for the solid-liquid hybrid systems.

The solid flame retardant material has acceptable atmospheric properties and does not pose any global warming or ozone depletion threat during manufacturing, storage, and handling. Upon release, the solid materials are in a very reactive form and are removed readily by the fire or in the troposphere. In contrast, gas and liquid agents may not fully react when utilized, thus posing a threat to the environment. The flame retardant materials of the present invention are of low toxicity or are nontoxic. The flame retardant materials are available in many forms and sizes and are inexpensive.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A solid-solid hybrid gas generator composition consisting essentially of a solid gas generator material and a solid bromine-containing flame retardant material.

2. The gas generator composition according to claim 1, wherein said flame retardant material comprises a bromine-containing compound having a bromine content greater than 58%.

3. The gas generator composition according to claim 1, wherein the flame retardant material is selected from the group consisting of tetrabromobisphenol A, tribromophenol, brominated diphenyl oxides, dibromostyrene, tetrabromophthalic anhydride, hexabromocyclododecane, and combinations thereof.

4. The gas generator composition according to claim 1, wherein the gas generator material comprises a nitrogen compound selected from the group consisting of ammonium 5-nitroaminotetrazole, triaminoguanidinium 5-nitroaminotetrazole, aminoguanidinium 5,5'-bitetrazole, and guanidinium 5,5'-bitetrazole.

5. The gas generator composition according to claim 4, wherein the gas generator material further comprises a polymer.

6. The gas generator composition according to claim 5, wherein the polymer is a copolymer of 3,3-bis(azidomethyl) oxetane and tetrahydrofuran or a copolymer of 3,3-bis (azidomethyl) oxetane and 3-nitromethyl-3-methyloxetane.

7. The gas generator composition according to claim 5, wherein a weight ratio of the nitrogen compound to the polymer is about 50:50.

8. The gas generator composition according to claim 1, wherein the gas generator material and flame retardant material are in the same vessel.

9. A process for suppressing a fire comprising:

producing an inert gas and a chemically-acting fire suppression agent from a composition consisting essentially of solid gas generator material and a solid, bromine-containing flame retardant material; and applying the inert gas and the agent to the fire.

10. The process according to claim 9, wherein the produced inert gas is $N_2$, $O_2$, $H_2O$ or $CO_2$.

11. A system for suppressing a fire, comprising a vessel containing a gas generator composition consisting essentially of a solid gas generator material and a solid, bromine-containing flame retardant material.

12. The system according to claim 11, wherein the flame retardant material is selected from the group consisting of tetrabromobisphenol A, tribromophenol, brominated diphenyl oxides, dibromostyrene, tetrabromophthalic anhydride, hexabromocyclododecane, and combinations thereof.

13. The system according to claim 11, wherein the gas generator material comprises a nitrogen compound selected from the group consisting of ammonium 5-nitroaminotetrazole, triaminoguanidinium 5-nitroaminotetrazole, aminoguanidinium 5,5'-bitetrazole, and guanidinium 5,5'-bitetrazole.

14. The gas generator composition according to claim 1, wherein the flame retardant material is selected from the group consisting of tetrabromobisphenol A, tribromophenol, dibromostyrene, tetrabromophthalic anhydride, hexabromocyclododecane, and combinations thereof.

15. A solid-solid hybrid gas generator composition, comprising:

a solid gas generator material; and a solid halogen-containing flame retardant material comprising at least one of chlorine- or phosphorous-containing compounds.

16. A process for suppressing a fire comprising:

producing an inert gas and a chemically-acting fire suppression agent from a solid gas generator material and a solid flame retardant material comprising at least one of chlorine- or phosphorous-containing compounds; and applying the inert gas and agent to the fire.

17. A system for suppressing a fire, comprising a vessel containing a gas generator composition comprising a solid gas generator material and a solid flame retardant material comprising at least one of chlorine- or phosphorous-containing compounds.

* * * * *